US005494436A

United States Patent [19]

Hwang

[11] Patent Number: 5,494,436

[45] Date of Patent: Feb. 27, 1996

[54] GAS LIGHTER WITH A SAFETY KNOB

[76] Inventor: Ing F. Hwang, No. 2, Lane 22, Sec. 2, Rd. Shan-Shi Rd., Taichung, Taiwan

[21] Appl. No.: 390,178

[22] Filed: Feb. 17, 1995

[51] Int. Cl.[6] ..... F23D 11/36

[52] U.S. Cl. ..... 431/153; 431/277

[58] Field of Search ..... 431/276, 277, 431/153

[56] References Cited

U.S. PATENT DOCUMENTS

| | | | |
|---|---|---|---|
| 5,090,893 | 2/1992 | Floriot | 431/153 |
| 5,165,886 | 11/1992 | Frigiere | 431/153 |
| 5,186,618 | 2/1993 | Shike et al. | 431/153 |
| 5,205,729 | 4/1993 | Iwahori | 431/153 |
| 5,356,286 | 10/1994 | Sher | 431/277 X |

*Primary Examiner*—Carl D. Price
*Attorney, Agent, or Firm*—Pro-Techtor International

[57] ABSTRACT

A gas lighter including a safety knob mounted on the holder frame at the top of the butane well and covered by a casing, which holds the gas lever and the striker wheel, the safety knob being moved horizontally between a locking position to stop the gas lever from turning downward in releasing the fuel gas, an unlocking position for permitting the gas lever to be depressed to release the fuel gas, the safety knob having a hooked end alternatively engaged in two retaining holes on the casing, the gas lever having a bottom rod, which is inserted into one retaining hole on the casing to push the hooked end of the safety knob from the unlocking position to the locking position when the gas lever is depressed.

1 Claim, 5 Drawing Sheets

GAS LIGHTER WITH A SAFETY KNOB

BACKGROUND OF THE INVENTION

The present invention relates to gas lighters, and relates more particularly to a safety knob for a gas lighter which can be moved between the locking position to stop the gas lever from operating, and the unlocking position to let the gas lever to be operated.

Regular disposable gas lighters are commonly comprised of a butane well molded from transparent plastics to hold a fuel gas, a holder frame covered on the top open side of the butane well to hold a dip tube and a valve rod, and a casing mounted on the holder frame to hold a gas lever and a striker wheel. When the gas lever is depressed, the valve rod is lifted to release the fuel gas, and therefore the striker wheel can be operated to ignite the fuel gas. This structure of disposable gas lighter is functional, however the gas lever may be easily triggered to release the fuel gas by an error. In order to prevent the happening of an accident, there are certain countries executing the rule of defining a safety requirement on disposable gas lighters. Various safety devices for use with gas lighters have been developed. Exemplars are shown in U.S. Pat. No. 5,186,618 issued to SHIKE; U.S. Pat. No. 5,205,729 issued to IWAHORI; U.S. Pat. No. 5,165,886 issued to FRIGIERE; U.S. Pat. No. 5,090,893 issued to FLORIOT. These disclosures commonly show the use of moving a safety knob the locking position and the unlocking position to stop the release of the fuel gas when the gas lever is triggered by an error. However, when the safety knob is moved into the locking position, the gas lever will be forced upwards at a short distance, causing a certain amount of the fuel gas released. Furthermore, the safety knob return mechanisms of the gas lighters disclosed are commonly complicated, and therefore they are difficult to install and tend to be damaged.

SUMMARY OF THE INVENTION

According to one aspect of the present invention, the safety knob is mounted on the holder frame at the top of the butane well, and moved between the locking position to stop the gas lever from turning downward in releasing the fuel gas and the unlocking position for permitting the gas lever to be depressed. The safety knob has two curved projecting rods moved in respective tracks on the casing, which holds the gas lever and the striker wheel. The projecting rods have a respective raised portion. The gas lever has bottom notches, which receive the raised portions of the projecting rods of the safety knob. When the safety knob is moved, the raised portions of the projecting rods are shifted between the bottom notches to keep the gas lever supported at a different bearing point, and therefore the gas lever will not be depressed by an error to release the fuel gas.

DETAILED DESCRIPTION OF THE PREFERRED EMBODIMENT

Figure 1:
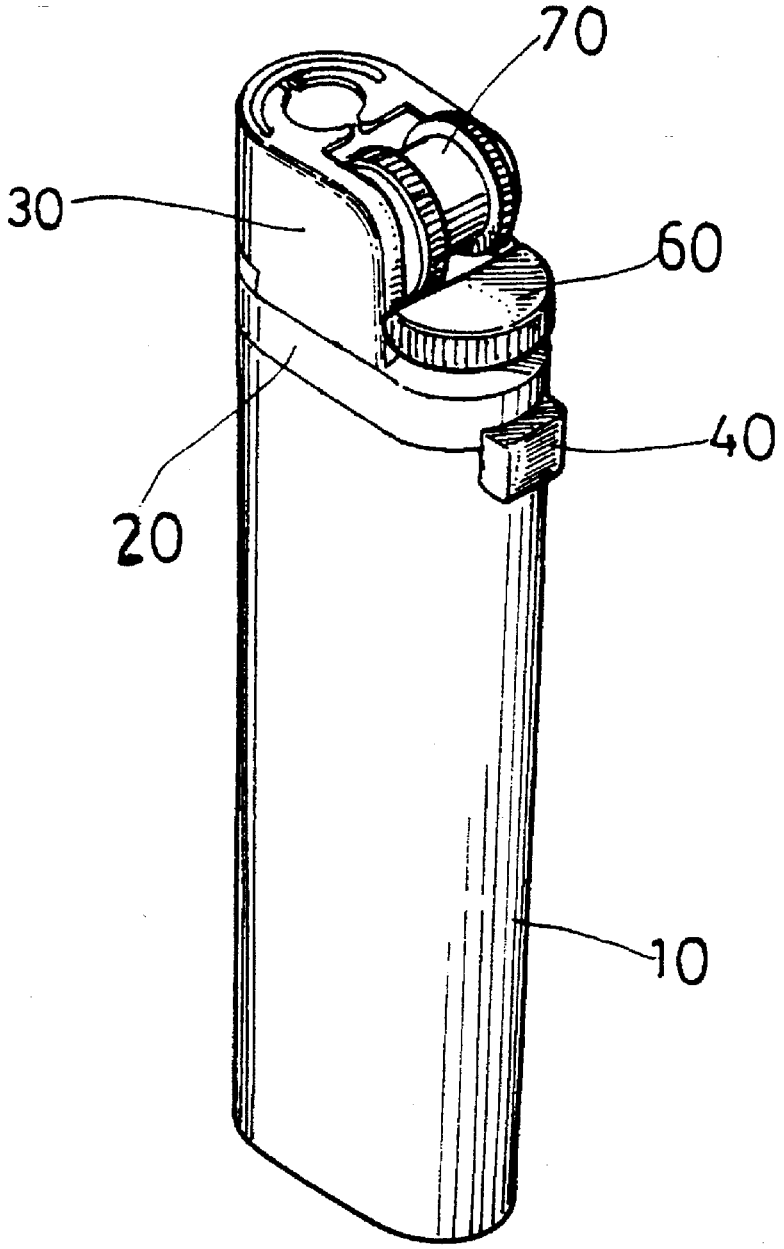
FIG. 1 is an elevational view of a gas lighter according to the present invention.
Figure 2:
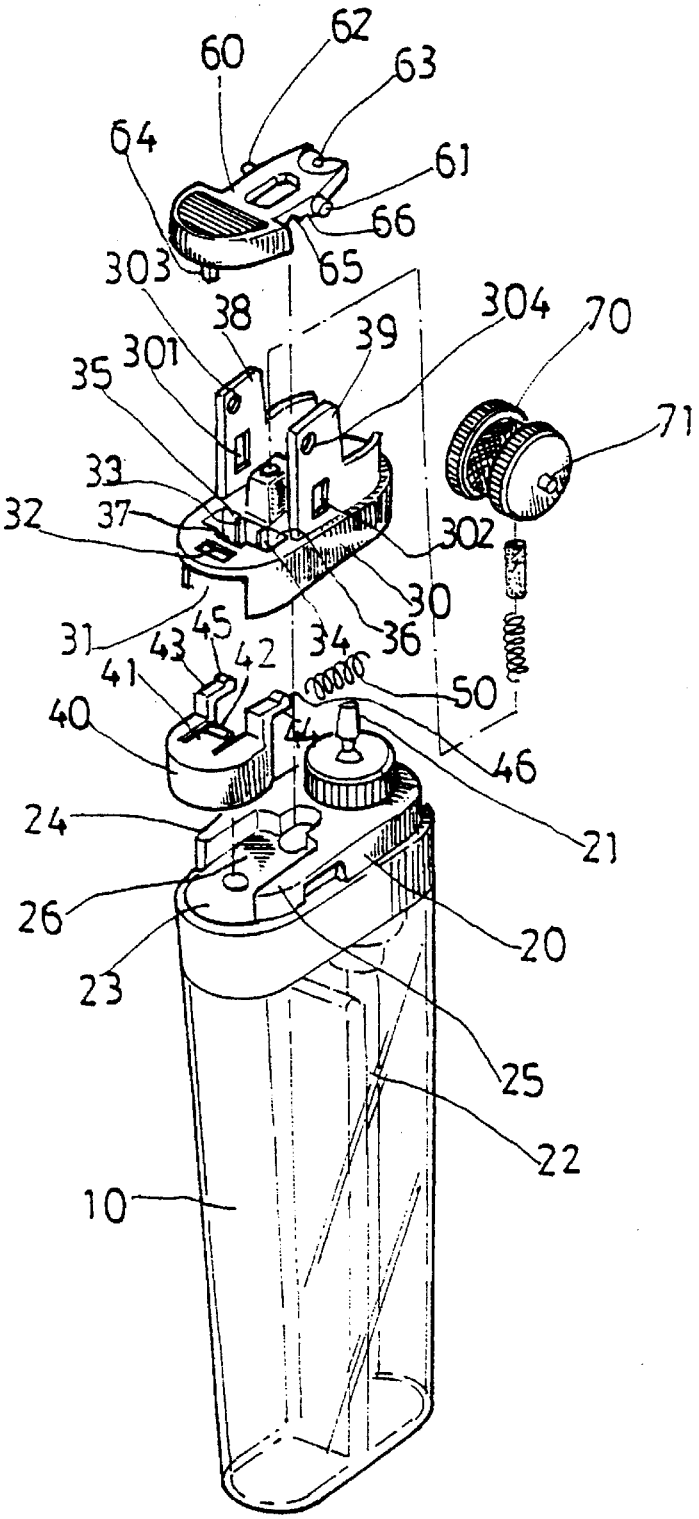
FIG. 2 is an exploded view of the gas lighter shown in FIG. 1.
Figure 3:
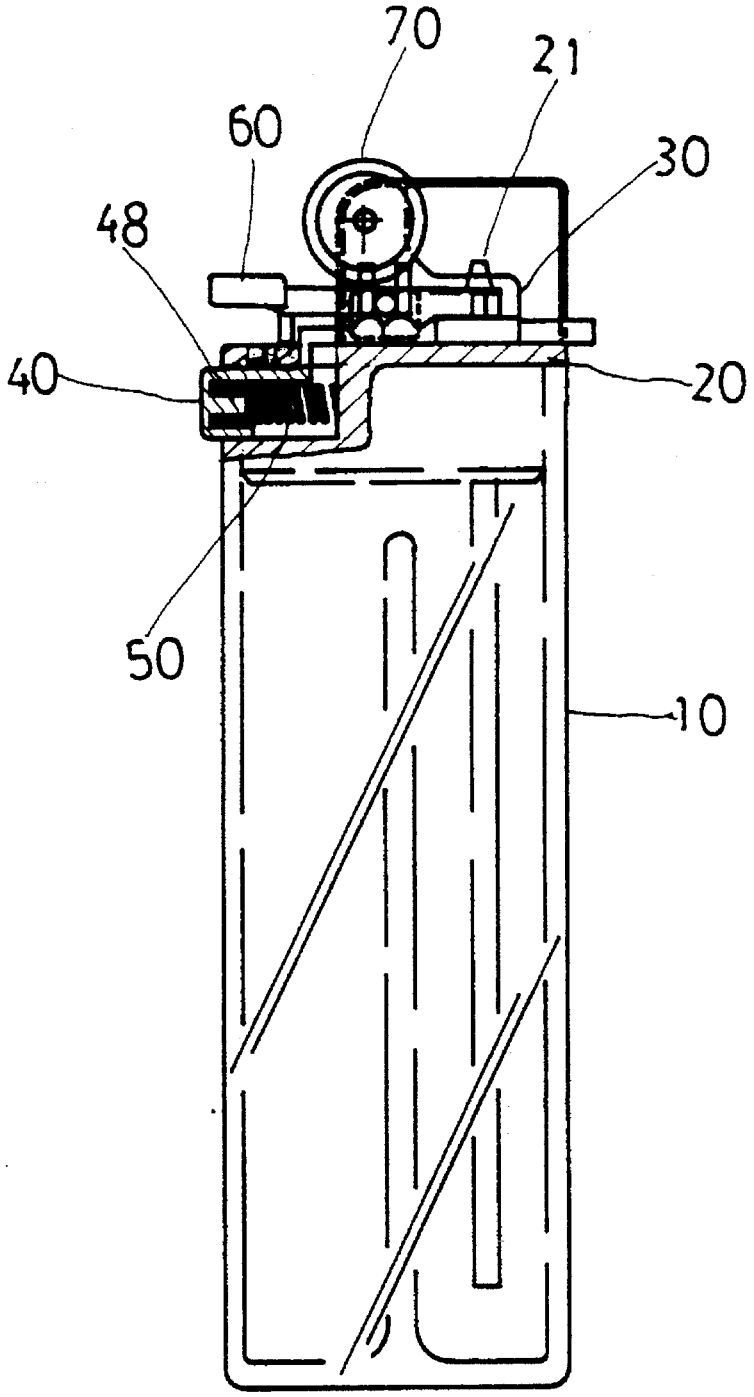
FIG. 3 is a longitudinal view in section of the gas lighter shown in FIG. 1.

Referring to FIGS. 1 and 2, a gas lighter is shown comprised of a butane well 10, which holds a fuel gas. A holder frame 20 is covered on butane well 10 at the top. A dip tube 23 is mounted on the holder frame 20 and extended into the butane well 10. A valve rod 21 is mounted in the top end of the dip tube 23 and moved up and down to close or open the dip tube 23. The holder frame 20 further comprises a flat bottom wall 23, and two rails 24 and 25 raised from the flat bottom wall 23 at two opposite sides and defining with the flat bottom wall 23 a recessed area 26.

A casing 30 is securely fixed to the rails 24 and 25 and bridged over the recessed area 26, having a front opening 31 communicated with the recessed area 26, a big retaining slot 32 adjacent to the front opening 31, a top opening 33, two vertical rails 34 disposed in the top opening 33 and defining two parallel tracks 35 and 36, a small retaining slot 37 adjacent to the top opening 33, and two upright supports 38 and 39 at two opposite lateral sides. A safety knob 40 is mounted within the recessed area 26 and covered by the casing 30 and partially extended out of the front opening 31. The safety knob 40 comprises a suspension strip 41 terminating in a hooked end 42, two curved projecting rods 43 and 44 disposed at two opposite sides by the suspension strip 41 and moved in the tracks 35 and 36 and having a respective raised portion 45 or 46 at the top, a pin 48 disposed below the suspension strip 41, and a spring 50 mounted on the pin 48 and stopped against the border of the recessed area 26. A gas lever 60 is pivotably connected between the two upright supports 38 and 39 of the casing 30, having two opposite pivot pins 61 and 62 at two opposite lateral sides respectively inserted into respective pivot holes 301 and 302 on the upright supports 38 and 39, a front pull end 63 coupled to the neck 22 of the valve rod 21, a bottom rod 64, and two retaining notches different sizes, namely the big retaining notch 65 and the small retaining notch 66 at the bottom side in front of the bottom rod 64. A striker wheel 70 is mounted on the casing 30 and turned about an axis between the upright supports 38 and 39, having two pivot pins 71 longitudinally aligned at two opposite sides and inserted into respective pivot holes 303 and 304 on the upright supports 38 and 39.

Figure 4:
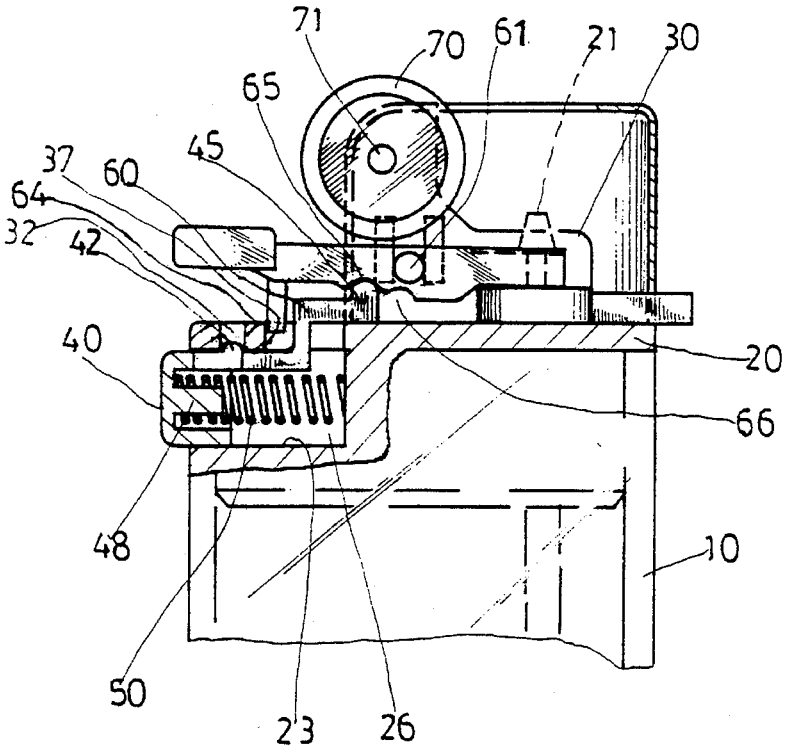
FIG. 4 is a partial view in section in an enlarged scale of FIG. 3, showing the gas lever stopped by the safety knob from turning downward.

Referring to FIG. 4, when the gas lighter does no work, the raised portions 45 and 46 of the projecting rods 43 and 44 are retained in the big retaining notch 65 on the gas lever 60 to stop the gas lever 60 from turning downward in lifting the valve rod 21. Therefore, no gas leakage will happen.

Figure 6:
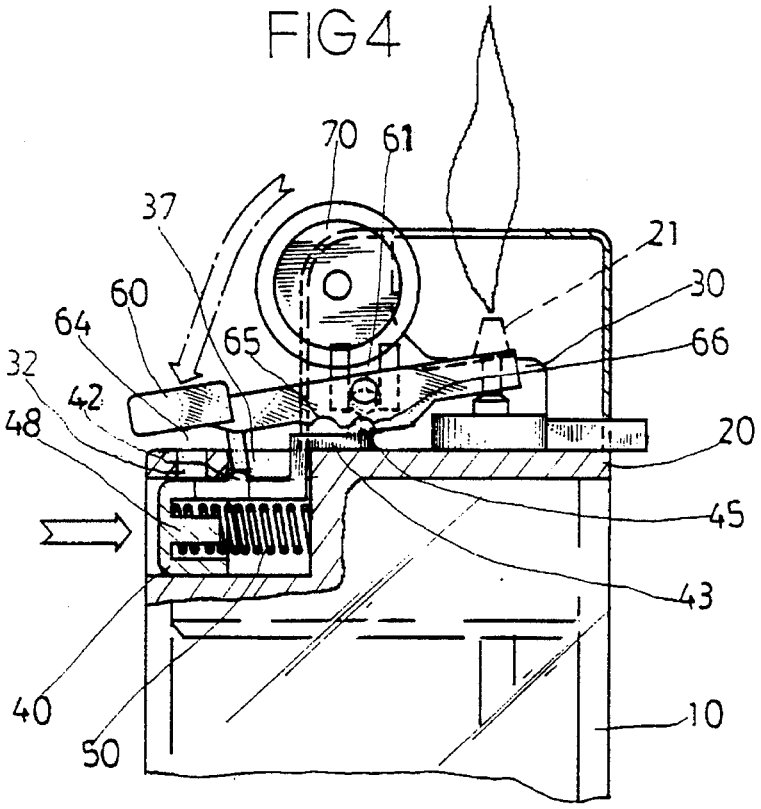
FIG. 6 is similar to FIG. 5 but showing the gas lever depressed and the striker wheel operated.
Figure 5:
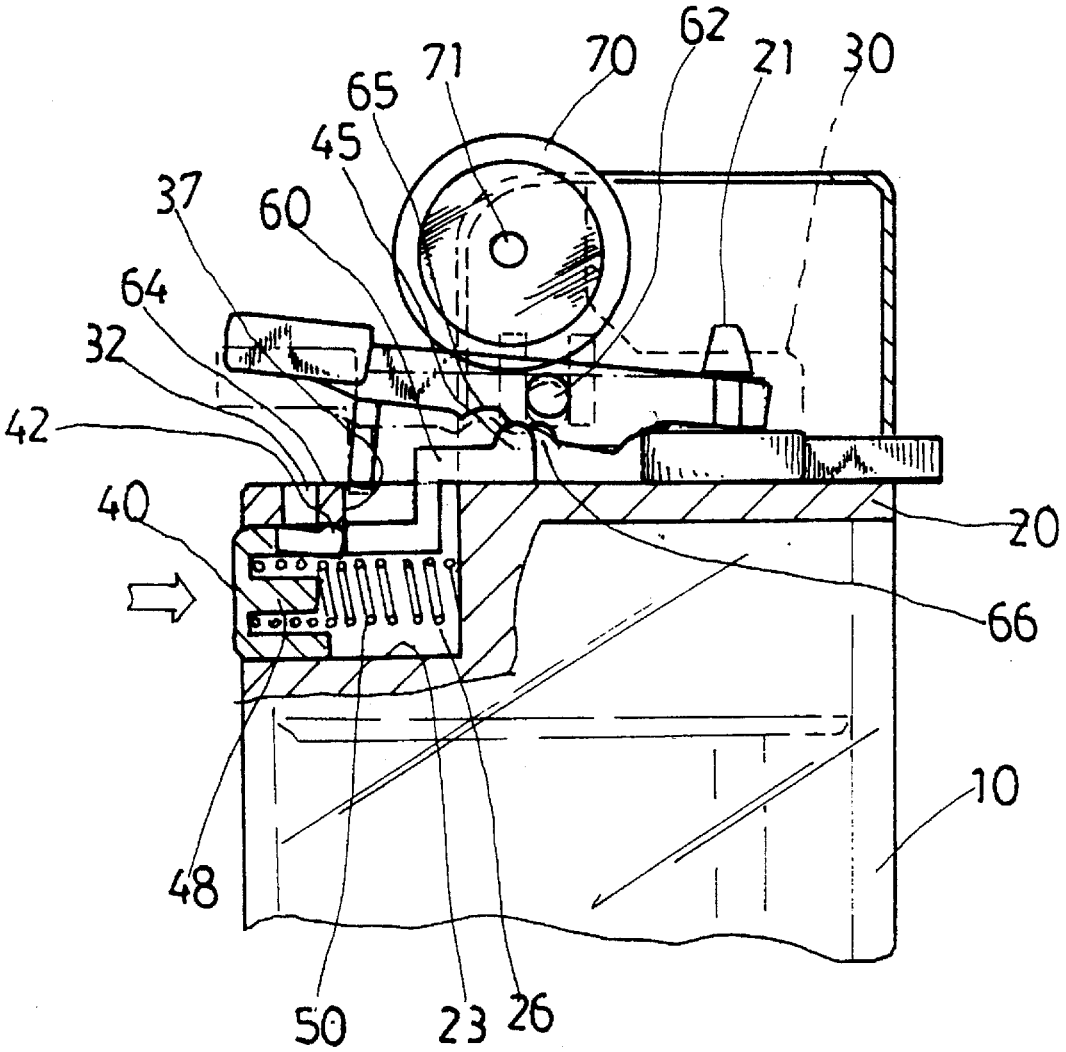
FIG. 5 is similar to FIG. 4 but showing the safety knob moved forwards.

Referring to FIGS. 5 and 6, when the safety knob 40 is moved horizontally forwards, the raised portions 45 and 46 are shifted from the big retaining notch 65 on the gas lever 60 to the small retaining notch 66, thereby raising gas lever 60 in the pivot holes 301 and 302. Pivot pins 61 and 62 are raised from the position shown in FIG. 4 to that shown in FIG. 6. (Pivot pin 62 not visible.) The position that pivot pin 61 holds in FIG. 4 is shown in phantom in FIG. 6. The exposed end of gas lever 60 may then be pressed down to lift the valve rod 21 in releasing the fuel gas. When the safety knob 40 is moved forwards to shift the raised portions 45 and 46 from the big retaining notch 65 to the small retaining notch 66, see also FIG. 2, the hooked end 42 of the suspension strip 41 is forced downwards and then moved from the big retaining slot 32 to the small retaining slot 37, and therefore the striker wheel 70 can be rotated to ignite the fuel gas. When the gas lever 60 is turned about the axis on the pivot pins 61 and 62, the bottom rod 64 is inserted into the small retaining slot 37 to push the hooked end 42 of the suspension strip 41 away from the small retaining slot 37, and the spring 50 immediately pushes the safety knob 40 back to its former position, causing the hooked end 42 of the suspension strip 41 moved from the small retaining slot 37 to the big retaining slot 32 again.

While only one embodiment of the present invention has been shown and described, it will be understood that various modifications and changes could be made without departing from the spirit and scope of the invention.

What is claimed is:

1. A gas lighter comprising:

a butane well having a top opening, said butane well holding a fuel gas;

a holder frame covering said top opening of said butane well, said cover frame having a dip tube dipped in the fuel gas in said butane well and a valve rod mounted in said dip tube and disposed outside said holder frame, said valve rod being lifted by a gas lever to allow fuel gas to flow from said butane well through said dip tube, a casing mounted on said holder frame and having two opposing upright supports;

said gas lever is pivotally mounted in said holder frame between said upright supports, a pivot point of said gas lever being movable in pivot holes in said upright supports, said gas lever raising and lowering said valve rod;

a striker wheel rotatably mounted on said holder frame between said upright supports above said gas lever;

and a safety knob mounted on said holder frame and covered by said casing, said safety knob extending from a front opening in said casing, said safety knob moving horizontally between a locking position that prevents said gas lever from lifting said valve rod and an unlocked position that allows said gas lever to raise said valve rod, said valve rod releasing the flow of fuel gas when it is raised by said gas lever; wherein said casing has a small retaining hole and a big retaining hole for the positioning of said safety knob, said safety knob comprising a suspension strip terminating in a hooked end, a pin, and a spring mounted on said pin, said hooked end being inserted into the small retaining hole of said casing to hold said safety knob in position when said safety knob is moved to said locking position, said hooked end being shifted from the small retaining hole of said casing and engaged into the big retaining hole thereof to hold said safety knob in position when said safety knob is moved to said unlocking position, said safety knob further comprising two curved projecting rods that move in tracks on said casing, each curved projecting rod has a raised portion, said raised portions are received in a pair of first bottom notches on said gas lever when said safety knob is moved to said locking position, said raised portions are received in a pair of second bottom notches of said gas lever when said safety knob is moved to said unlocking position.

* * * * *